US006402302B1

(12) United States Patent
Ozaki et al.

(10) Patent No.: US 6,402,302 B1
(45) Date of Patent: Jun. 11, 2002

(54) LIQUID DISCHARGE HEAD, MANUFACTURING METHOD THEREOF, AND MICROELECTROMECHANICAL DEVICE

(75) Inventors: Teruo Ozaki, Yokohama; Akihiro Yamanaka; Yoshiyuki Imanaka, both of Kawasaki; Masahiko Kubota, Tokyo; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/584,784

(22) Filed: Jun. 1, 2000

(30) Foreign Application Priority Data

Jun. 4, 1999 (JP) ..... 11-158821

(51) Int. Cl.[7] ..... B41J 2/05

(52) U.S. Cl. ..... 347/65; 347/63; 216/27; 430/320

(58) Field of Search ..... 347/63, 65, 94, 347/56; 29/890.1; 216/27; 430/320

(56) References Cited

U.S. PATENT DOCUMENTS 3,896,309 A * 7/1975 Halsor et al. ..... 257/254
5,396,066 A * 3/1995 Ikeda et al. ..... 250/306
5,619,177 A 4/1997 Johnson et al. ..... 337/140
5,693,545 A * 12/1997 Chung et al. ..... 437/40
5,838,351 A 11/1998 Weber ..... 347/85
5,897,789 A * 4/1999 Weber ..... 216/27
5,903,380 A * 5/1999 Motamedi et al. ..... 359/224
6,213,589 B1 * 4/2001 Silverbrook ..... 347/54

FOREIGN PATENT DOCUMENTS

| | | |
|---|---|---|
| EP | 0778133 | 6/1997 |
| EP | 0819537 | 1/1998 |
| JP | 10-76659 | 3/1998 |

OTHER PUBLICATIONS

Micromachined Transducers Sourcebook, Gregory Kovacs, 1998, The McGraw–Hill Companies Inc. pp. 289–296.*

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

There is provided a liquid discharge head including a substrate, a ceiling plate connected to the substrate, a liquid flow path formed between the substrate and the ceiling plate, and a cantilever-like movable member having a fixed end fixed to the substrate and a free end extending into the liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes bubbling of a liquid in the liquid flow path between the movable member and the substrate to discharge the liquid.

32 Claims, 13 Drawing Sheets

LIQUID DISCHARGE HEAD, MANUFACTURING METHOD THEREOF, AND MICROELECTROMECHANICAL DEVICE

BACKGROUND OF THE INVENTION

1. Field of the Invention

The present invention relates to a liquid discharge head, a manufacturing method thereof, and a microelectromechanical device.

2. Related Background Art

In a conventional liquid discharge head as an example of a microelectromechanical device for use in an ink-jet printer or the like, liquid is discharged from a discharge port by pressure generated by means of heating and thus bubbling the liquid in a liquid flow path. In order to heat the liquid, a heater for discharge is disposed on an element substrate. Driving voltage is supplied to the heater for discharge through wirings on the element substrate.

Recently, with regard to such a liquid discharge head, a structure has been proposed where, for the purpose of introducing most of the bubble to the side of the discharge port to improve the discharge efficiency, a cantilever-like movable member with one end thereof being supported is disposed in the liquid flow path. One end of the movable member is fixedly supported on the element substrate while the other end extends into the liquid flow path. In this way, the movable member is structured so as to be held at a certain distance over the element substrate and so as to be movable in the liquid flow path by the pressure generated by bubbling or the like.

Japanese Patent Application Laid-Open No. 10-76659 discloses, among liquid discharge heads having the above-mentioned movable member in the liquid flow path, one where the movable member is provided with a heater for discharge.

However, as shown in FIG. 14, in the heater for discharge disclosed in Japanese Patent Application Laid-Open No. 10-76659, electrothermal converting member electrodes 1204 and 1205 are formed so as to be folded back along the surface of the movable member. When the electrothermal converting members are laid out in this way, the position of the heater 1206 for discharge is unsymmetrical in the width direction of the movable member, which results in the tendency for the movable member to be distorted in bubbling, and thus, there are some cases where the durability of the movable member is not necessarily satisfactory. In addition, since the width of the electrodes is not sufficient, the structure is not suitable for passing heavy current therethrough.

SUMMARY OF THE INVENTION

Accordingly, an object of the present invention is to provide a liquid discharge head and a microelectromechanical device with satisfactory durability and reliability where a movable member in a liquid flow path comprises a heater for discharge.

According to an aspect of the present invention, there is provided a liquid discharge head comprising a substrate, a ceiling plate bonded to the substrate, a liquid flow path formed between the substrate and the ceiling plate, and a cantilever-like movable member having a fixed end fixed to the substrate and a free end extending into the liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes bubbling of a liquid in the liquid flow path between the movable member an d the substrate to discharge the liquid.

According to another aspect of the present invention, there is provided a method of manufacturing a liquid discharge head which comprises a substrate, a ceiling plate bonded to the substrate, a liquid flow path formed between the substrate and the ceiling plate, and a cantilever-like movable member having a fixed end fixed to the substrate and a free end extending into the liquid flow path, the method comprising the steps of:

providing a space forming member on a substrate;

forming a movable member of a lower protective layer, a heat generating resistive layer, a lower electrode layer, an insulating layer, an upper electrode layer, and an upper protective layer stacked from the side of the substrate in the mentioned order; and removing the space forming member to shape the movable member in the form of a cantilever.

According to still another aspect of the present invention, there is provided a microelectromechanical device comprising a cantilever-like movable member having a fixed end fixed to a substrate and a free end extending into a liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes heating of a liquid in the liquid flow path.

It is to be noted that the upper electrode layer and the lower electrode layer are preferably formed of a high-melting metal.

The insulating layer is preferably made of SiN.

The heat generating resistive layer is preferably electrically connected to the electrode layers upstream and downstream with respect to the direction of discharge of the heat generating portion.

The upper electrode layer and the lower electrode layer are preferably formed so as to range from the front surface side to the rear surface side of the movable member.

Further, separately from the heat generating portion, the liquid flow path may further comprise therein a heater for adjustment provided correspondingly to the heater for discharge and a driver for the heater for adjustment for driving the heater for adjustment.

A voltage applied to the heater for adjustment may be lower than that applied to the heat generating portion.

The ceiling plate may be provided with a voltage converter to ensure that a voltage applied to the heater for adjustment is lower than a voltage applied to the heater for discharge.

A voltage applied to the heater for adjustment may be made lower than a voltage applied to the heater for discharge by connecting the heater for adjustment to a power source different from a power source connected to the heater for discharge.

A power source connected to the heater for adjustment may be common to a power source for a logic circuit.

The heater for adjustment may be provided on the downstream side with respect to the direction of discharge of the heater for discharge.

The heater for adjustment may be provided on the upstream side with respect to the direction of discharge of the heater for discharge.

A plurality of heaters for adjustment may be provided and they may be provided on the upstream side and the downstream side, respectively, with respect to the direction of discharge of the heater for discharge.

The area of the heater for adjustment is preferably smaller than that of the heater for discharge.

The area of the driver for the heater for adjustment is preferably smaller than that of the driver for the heater for discharge.

The signal generating portion of the driver for the heater for discharge may be the signal generating portion of the driver for the heater for adjustment.

The ceiling plate may further comprise a sensor for sensing the state in the liquid flow path corresponding to the heater for adjustment.

It is to be noted that the terms "upstream" and "downstream" as used herein shall refer to the direction of the liquid flow from the supply source of the liquid through a bubble generating region (or the movable member) to the discharge port, or refer to the direction with regard to the structure related to the liquid flow.

DESCRIPTION OF THE PREFERRED EMBODIMENTS

Preferred embodiments of the present invention are now described in detail with reference to the drawings.

Embodiment 1

Figure 1:
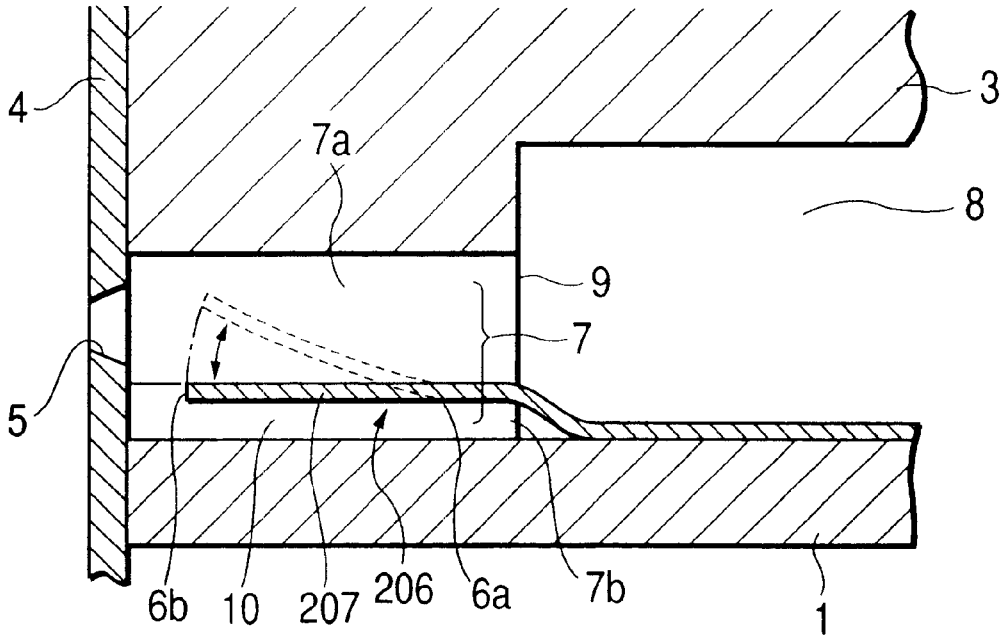
FIG. 1 is a sectional view along the direction of a liquid flow path illustrating the structure of a liquid discharge head as a first embodiment of the present invention.

FIG. 1 illustrates a first embodiment of the present invention.

As shown in FIG. 1, a liquid discharge head of the present embodiment has a movable member 206 disposed in a liquid flow path 7 formed by an element substrate 1 and a ceiling plate 3. The movable member 206 is provided with a heater 207 for discharge on the side of the element substrate 1. The movable member 206 is a cantilever-like thin film disposed opposingly to the element substrate 1 so as to divide the liquid flow path 7 into a first liquid flow path 7*a* communicating with a discharge port 5 and a second liquid flow path 7*b* having a bubble generating region 10. The movable member 206 is formed of a silicon-based material such as silicon nitride or silicon oxide.

The movable member 206 is disposed at a predetermined distance from the element substrate 1 so as to have a fulcrum 6*a* on the upstream side of a large flow from a common liquid chamber 8 through the movable member 206 to the discharge port 5 due to the liquid discharge operation and a free end 6*b* on the downstream side, and so as to cover the element substrate 1 at a position facing the element substrate 1. The element substrate 1 and the heater 207 for discharge which is provided on the movable member 206 define the bubble generating region 10 therebetween.

The ceiling plate 3 is for forming a plurality of liquid flow paths 7 corresponding to the respective heaters 207 for discharge and for forming the common liquid chamber 8 for supplying liquid to the respective liquid flow paths 7, and is integrally provided with a liquid flow path side wall 9 extending from a ceiling portion to portions between the respective heaters 207 for discharge. The ceiling plate 3 is formed of a material of the silicon system, and may be formed by, for example, etching the pattern of the liquid flow path 7 and the common liquid chamber 9, or etching the portion of the liquid flow path 7 after a material of silicon nitride, silicon oxide, or the like to be the liquid flow path side wall 9 is deposited on a silicon substrate using a known film forming method such as CVD.

A plurality of discharge ports 5 corresponding to the respective liquid flow paths 7 and communicating through the respective liquid flow paths 7 with the common liquid chamber 8 are formed in an orifice plate 4. The orifice plate 4 is also formed of a material of the silicon system, and is formed by, for example, decreasing the thickness of a silicon substrate with the discharge ports 5 formed therein to be on the order of 10 to 150 $\mu$m. It is to be noted that the orifice plate 4 is not an essential element of the present invention, and, instead of providing the orifice plate 4, a ceiling plate having a discharge port may be formed by, when the liquid flow path 7 is formed in the ceiling plate 3, leaving a wall having a thickness corresponding to the thickness of the orifice plate 4 at the front end surface of the ceiling plate 3 and forming the discharge port 5 in this portion.

In the structure described in the above, when the heater 207 for discharge generates heat, the heat acts on liquid in the bubble generating region 10 between the element substrate 1 and the heater 207 for discharge. This results in generation and growth of a bubble on the surface of the heater 207 for discharge based on the film boiling phenomenon. Pressure increased by the growth of the bubble preferentially acts on the movable member 206 to move the movable member 206 so as to be widely open on the side of the discharge port 5 with the fulcrum 6*a* being as the center of the movement, as shown by a broken line in FIG. 1. The movement or the moved state of the movable member 206 makes the conveyance of pressure due to the bubble generation and the growth of the bubble itself introduced to the side of the discharge port 5, resulting in discharge of the liquid from the discharge port 5.

More specifically, by providing over the bubble generating region 10 the movable member 206 having the fulcrum 6*a* on the upstream side of the liquid flow in the liquid flow path 7 (on the side of the common liquid chamber 8) and having the free end 6*b* on the downstream side (on the side of the discharge port 5), the direction of conveyance of pressure of the bubble is introduced to the downstream side, which makes the pressure caused by the bubble directly and efficiently contribute to discharge. Further, the direction of growth of the bubble itself is introduced to the downstream direction as well as the direction of conveyance of pressure, and the bubble grows larger downstream than upstream. In this way, by controlling the bubble growth direction itself and the pressure conveyance direction by the movable member, fundamental discharge characteristics such as the discharge efficiency, the discharge force, and the discharge rate can be improved.

On the other hand, in a defoaming process of the bubble, the bubble rapidly disappears as the synergic effect with the elastic force of the movable member 206. The movable member 206 ultimately returns to the initial position shown by a solid line in FIG. 1. Here, liquid flows in from the upstream side, i.e., from the side o f the common liquid chamber 8 to compensate for the volume of the shrinkage of the bubble in the bubble generating region 10 and to compensate for the volume of the discharged liquid, and the liquid flow path 7 is refilled with the liquid. This liquid refilling is carried out with efficiency, reasonableness, and stability with the helm of the returning movable member 206.

Further, the liquid discharge head of the present embodiment has circuits and elements for driving the heater 207 for discharge and for controlling the driving of the heater 207 for discharge. These circuits and elements are disposed either on the element substrate 1 or on the ceiling plate 3 according to their functions. Since the element substrate 1 and the ceiling plate 3 are formed of a silicon material, these circuits and elements can be formed easily and minutely using the semiconductor wafer process technology.

Next, a method of manufacturing the movable member 206 is described with reference to FIGS. 2A to 2C, 3A to 3C and 4A to 4C.

Figure 2A:
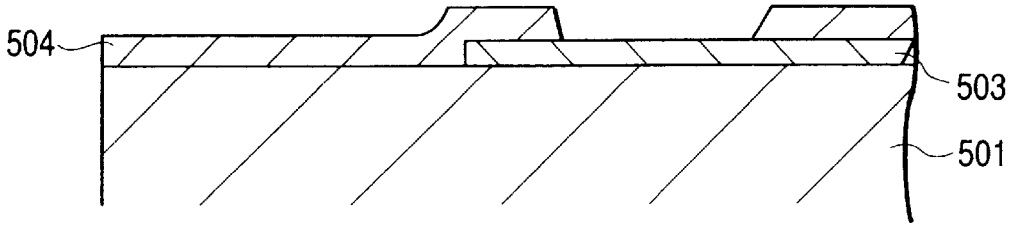
FIGS. 2A, 2B and 2C are sectional views illustrating a first process in the method of manufacturing the liquid discharge head as the first embodiment of the present invention.
Figure 2B:
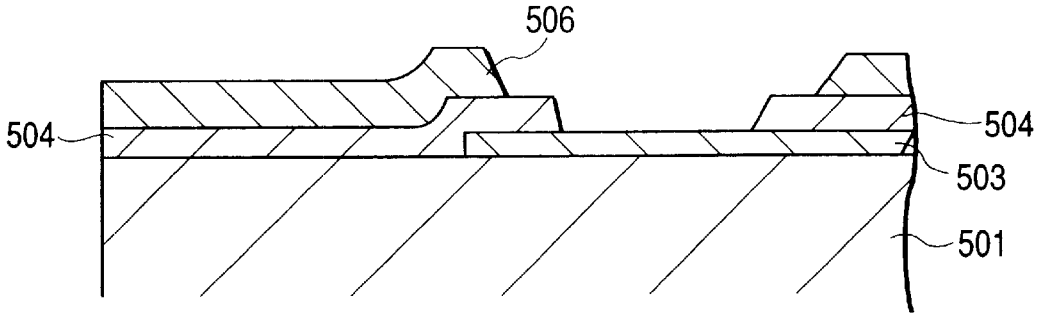
Figure 2C:
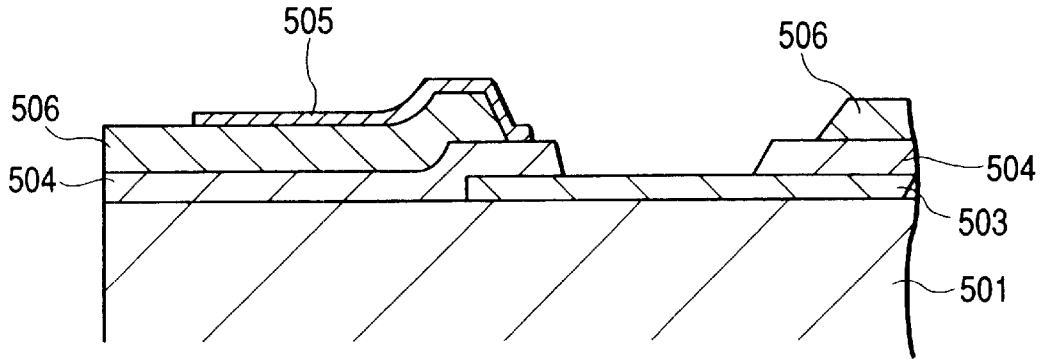
Figure 3A:
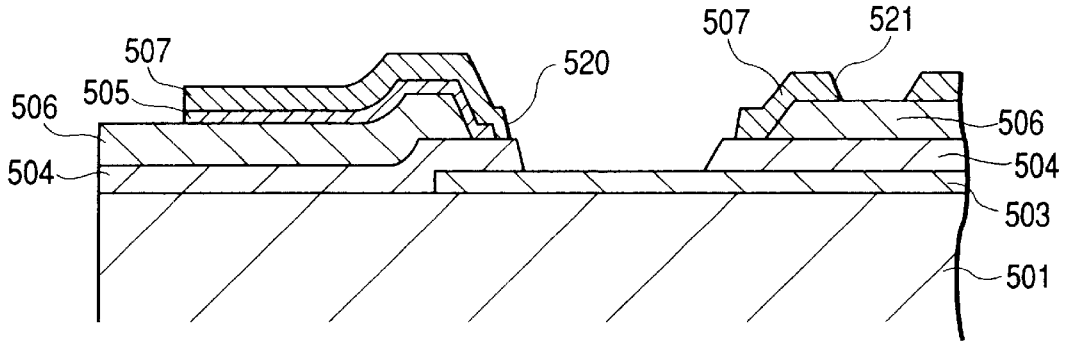
FIGS. 3A, 3B and 3C are sectional views illustrating a second process in the method of manufacturing the liquid discharge head as the first embodiment of the present invention.

First, on a silicon substrate 501 having an IC formed thereon and an insulating layer 502 stacked thereon, a wiring 503 of aluminium is formed by sputtering at the thickness of about 1 $\mu$m, and is patterned into a predetermined pattern using photolithography and dry etching. Next, as shown in FIG. 2A, an electrode protective layer 504 of SiN is formed by CVD at the thickness of 1 $\mu$m Then, as shown in FIG. 2B, a space forming member 506 comprised of Al is formed by sputtering at the thickness of about 5 $\mu$m and is patterned into a predetermined pattern by photolithography and dry etching. Next, as shown in FIG. 2C, an anticavitation layer (Ta layer) 505 for a bubble generating portion to be formed thereon later is formed at the thickness of 2000 Å, and is patterned into a predetermined pattern by photolithography and dry etching. Then, as shown in FIG. 3A, a heater protective layer 507 of SiN is formed by CVD at the thickness of 0.1 to 0.5 $\mu$m, and through holes 520 and 521 are formed by photolithography and dry etching.

Figure 3B:
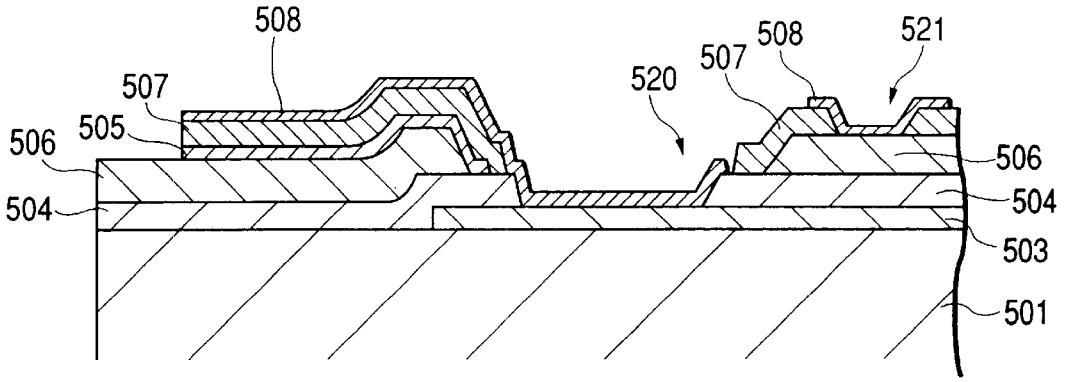
Figure 3C:
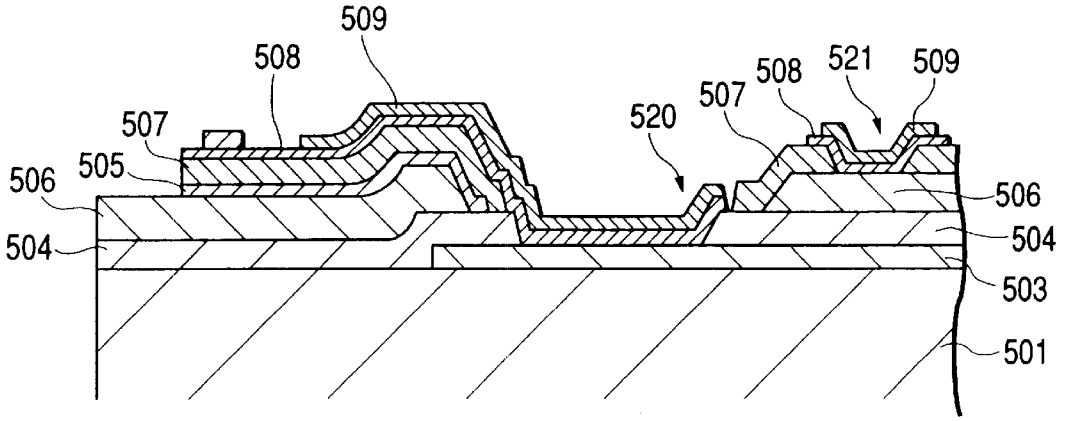

Then, as shown in FIG. 3B, a resistive layer (heater for discharge) 508 of TaN is formed by sputtering at the thickness of 1000 Å and then, continuously, as shown in FIG. 3C, wirings 509 of Cu are formed also by sputtering at the thickness of 3000 Å. An electrode and a heat acting portion are formed by photolithography and etching. This allows the wirings 509 connected with the resistive layer (heater for discharge) 508 to be connected to the wirings 503 through the through hole 520.

Further, for the purpose of enhancing the connectivity between turned up/down wirings 511 and VH wirings (wirings for supplying a signal voltage) to be described later, wirings 509 of Cu are formed as an electrode portion so as to cover the through hole 521 on the space forming member 506.

Figure 4A:
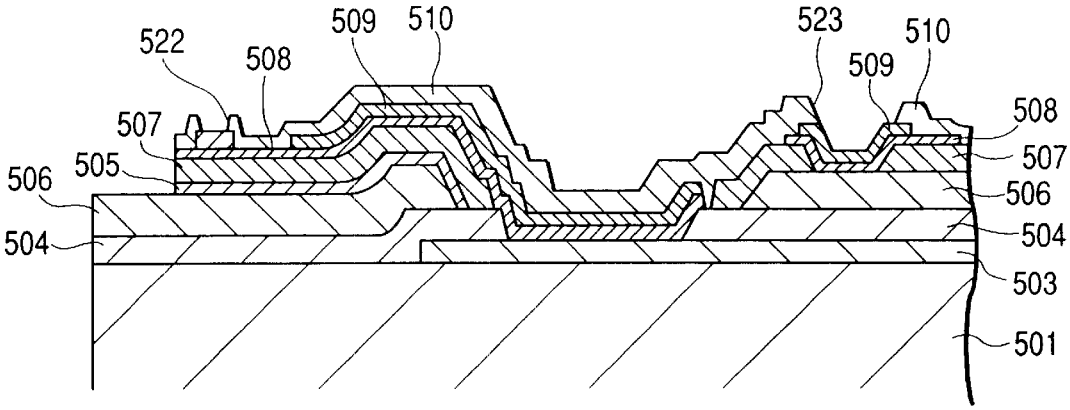
FIGS. 4A, 4B and 4C are sectional views illustrating a third process in the method of manufacturing the liquid discharge head as the first embodiment of the present invention.

Then, as shown in FIG. 4A, a heat accumulating layer 510 of SiO is formed by CVD at the thickness of 2.0 $\mu$m and through holes 522 and 523 are formed by photolithography and etching on the electrode portion 509 on the VH wirings and on the wirings 509 of the turned up/down portion of the resistive layer 508.

Figure 4B:
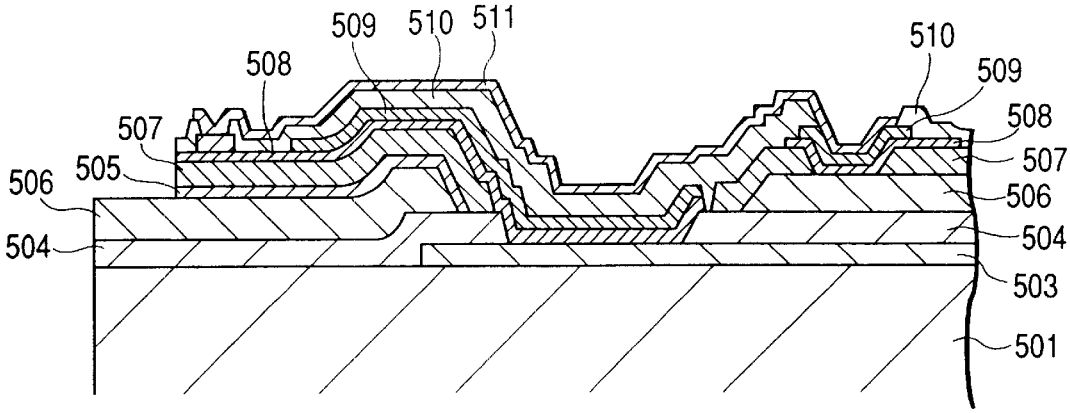

Then, as shown in FIG. 4B, wirings 511 of Cu which are turned up/down wirings are formed by sputtering at the thickness of 5000 Å, which is then patterned into a predetermined pattern by lithography and etching. As a result, turned up/down wirings 509 and 511 for connecting the resistive layer 508 to the wirings 503 are formed.

Figure 4C:
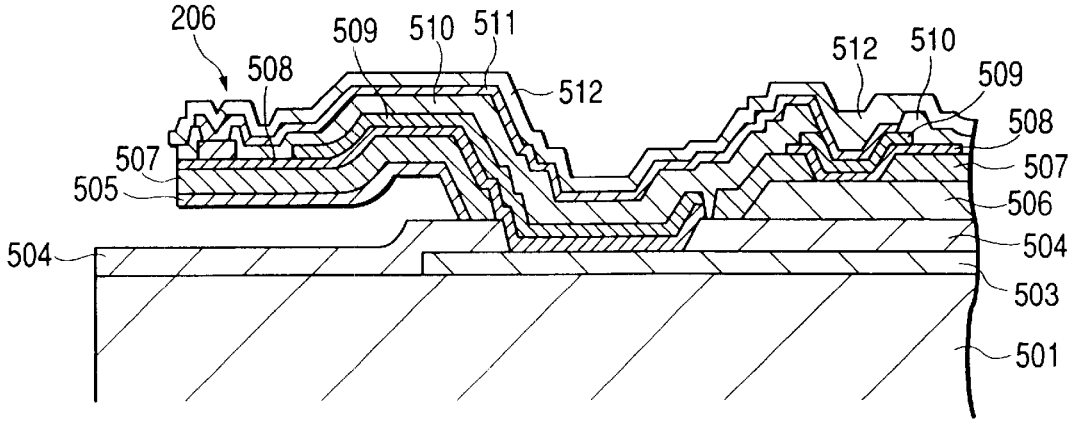
Figure 5:
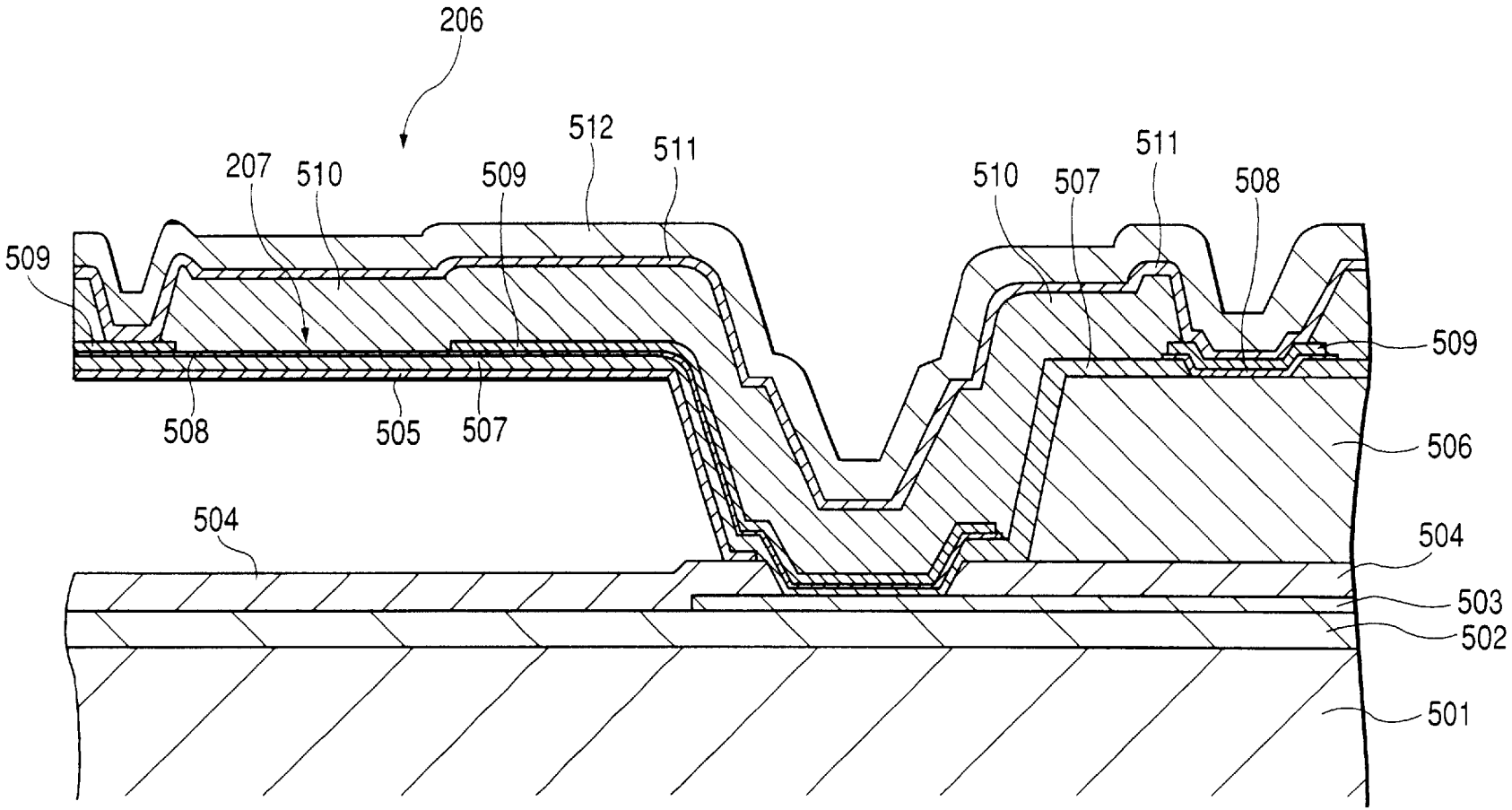
FIG. 5 is an enlarged partial sectional view of the liquid discharge head as the first embodiment of the present invention.

Next, as shown in FIG. 4C, a protective layer 512 of SiN for the turned up/down wirings is formed by CVD at the thickness of 1 $\mu$m. Then, the layers from the protective layer 512 to the anticavitation layer 505 are continuously patterned in the shape of the movable member 206 by photolithography and dry etching. Then, part of the space forming member 506 is removed by wet etching to form the movable member 206. Finally, an electrode pad for connection to the external is formed by photolithography and etching, the state of which is shown in FIG. 5.

It is to be noted that, since no heater is provided on the element substrate 1 and the ceiling plate 3, wirings and the like other than the above-mentioned wirings for connection to the movable member 206 are not formed.

In this way, when a liquid discharge head comprising a substrate, a ceiling plate connected to the substrate, a liquid flow path formed between the substrate and the ceiling plate, and a cantilever-like movable member having a fixed end fixed to the substrate and a free end extending into the liquid flow path is structured such that the movable member is formed by stacking a lower protective layer, a heat generating resistive layer, a lower electrode layer, an insulating layer, an upper electrode layer, and an upper protective layer from the side of the substrate in this order, and such that applying a voltage to a heat generating portion of the heat generating resistive layer forms a bubble in the liquid in the liquid flow path between the movable member and the substrate to discharge the liquid, the bubbling surface of the movable member can be made flat, which makes it possible to improve the durability of the heat generating portion.

The above-mentioned structure can be formed by the steps of providing a space forming member on the substrate, forming the movable member by stacking the lower protective layer, the heat generating resistive layer, the lower electrode layer, the insulating layer, the upper electrode layer, and the upper protective layer from the side of the substrate in this order and removing the space forming member to shape the movable member into the form of a cantilever.

With regard to the heater 207 for discharge formed in the movable member formed in this way, since the layers below the resistive layer 508 are thinner than the layers above the resistive layer 508, a bubble is generated on the lower side. Further, since the movable member 206 jumps up due to the reaction of bubbling, less ink escapes backward to improve the bubbling efficiency. Further, since the defoaming portion is not fixed to a surface because of the moving bubbling surface, concentration of the cavitation is less liable to occur to improve the lifetime of the substrate 501 and the like. Still further, since the heater for discharge can be formed symmetrically in the width direction of the movable member, distortion of the movable member in operation can be decreased. Further, since the side of the bubbling surface is structured to be flat with no step of the electrode, influence of thermal shock is less liable to occur to improve the lifetime of the movable member. In addition, with regard to the insulating layer as the main material of the movable member which is normally formed of a ceramic material, since both sides of the ceramic member are provided with an electrode, the insulating layer is reinforced, which results in further improvement in the durability of the movable member.

Further, if the upper electrode layer and the lower electrode layer are formed of a high-melting metal, hillocks and distortion due to stress of the electrode layers can be prevented.

Embodiment 2

Figure 6:
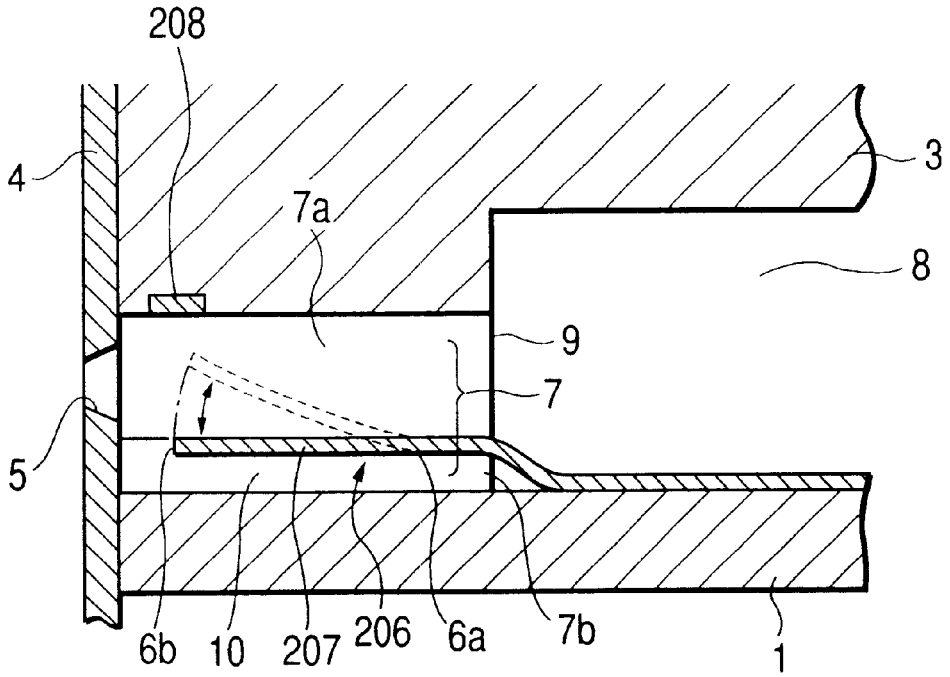
FIG. 6 is a sectional view along the direction of a liquid flow path illustrating the structure of a liquid discharge head as a second embodiment of the present invention.

FIG. 6 illustrates a second embodiment of the present invention. In the present embodiment, the heater 207 for discharge is provided on the movable member 206, and, similarly to the case of the first embodiment, a heater 208 for heating is formed on the ceiling plate 3.

First, as one embodiment to which the present invention is applicable, a liquid discharge head is described. The liquid discharge head has a plurality of discharge port for discharging liquid, first and second substrates for, by being connected to each other, forming a plurality of liquid flow paths communicating with the discharge ports, respectively, a plurality of energy conversion elements disposed in the liquid flow paths, respectively, for converting electric energy into energy for discharging liquid in the liquid flow paths, and a plurality of elements or electric circuits having different functions for controlling the conditions for driving the energy conversion elements. The elements and electric circuits are disposed either on the first substrate or on the second substrate according to their functions.

Figure 7A:
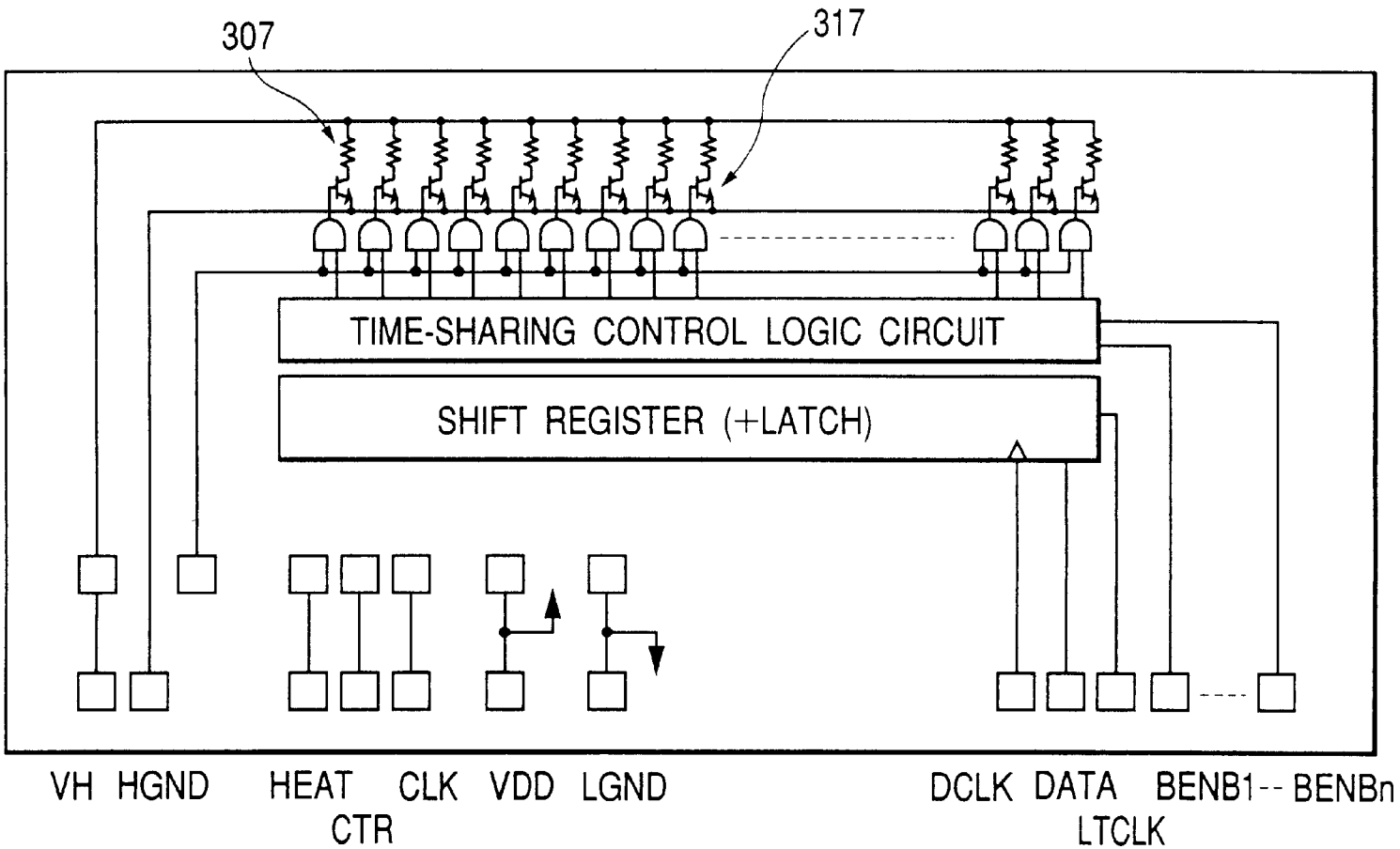
FIGS. 7A and 7B are schematic views of a substrate and a ceiling plate, respectively, of the liquid discharge head shown in FIG. 6.
Figure 7B:
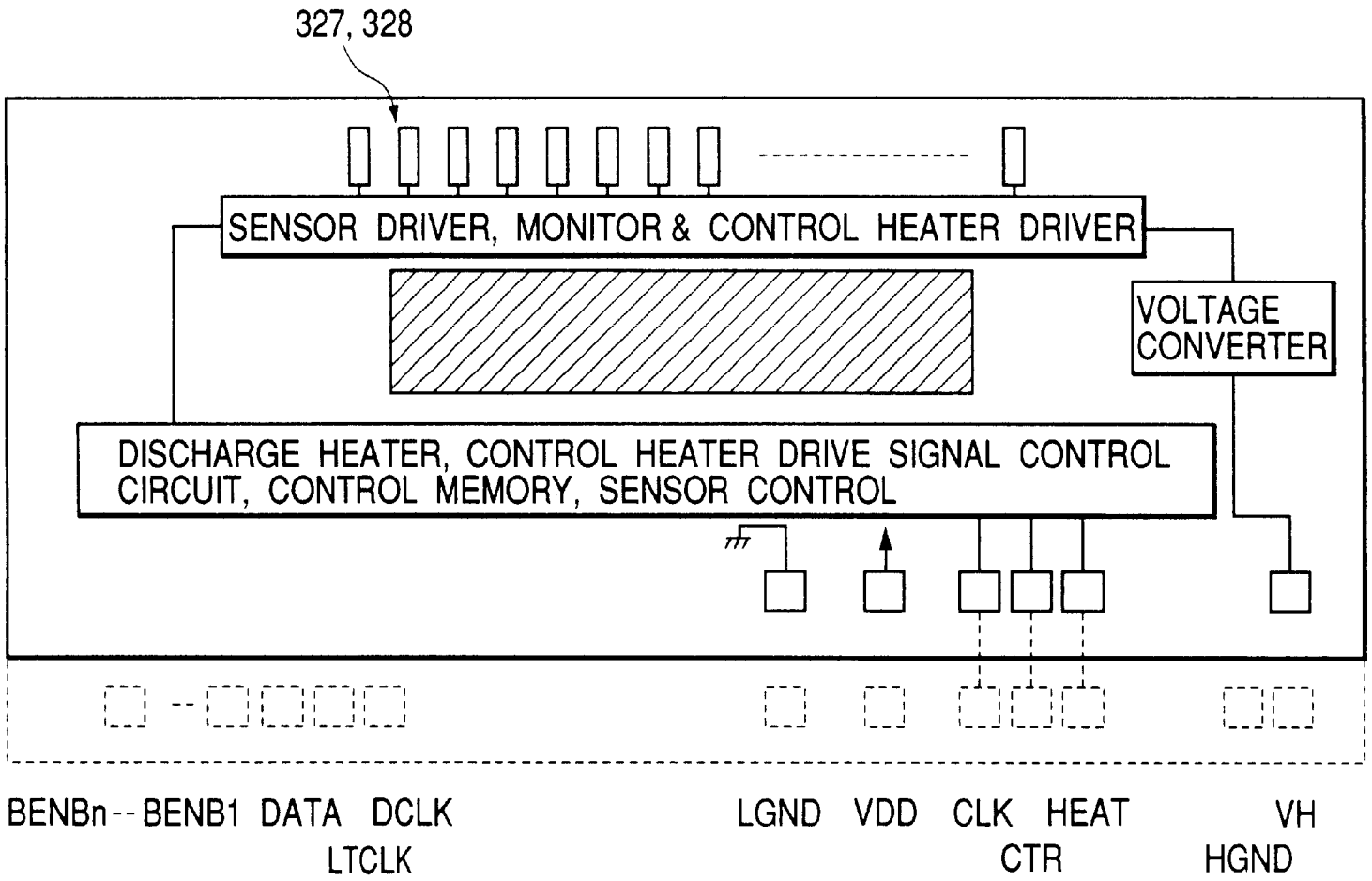

The circuit structure of the liquid discharge head is schematically shown in FIGS. 7A and 7B. As shown in FIG. 7A, the substrate 1 is provided with a plurality of heaters 307 for discharge and drivers 317 thereof, a time-sharing control logic circuit, and a shift register. As shown in FIG. 7B, the ceiling plate 3 is provided with heaters for heating (heaters for adjustment or control heaters) 327, sensors 328, drivers thereof, a voltage converter, and a control circuit including a memory and the like. Since the sizes of the heaters for heating and the sensors can be optimized, miniaturization thereof as well as of the drivers can be made. The voltage converter is provided for the purpose of making the voltage applied to the heaters for adjustment (for heating) lower than that to the heaters for discharge.

The present embodiment is adapted to always maintain a constant discharge performance by operating the heater 208 for heating according to the temperature of the liquid to adjust the viscosity of the liquid. More specifically, in case the liquid in the vicinity of the discharge port is too viscid, the heater 208 for heating can operate at appropriate timing to locally heat the liquid resulting in decrease in the viscosity of the liquid. This makes it possible to obtain desired discharge characteristics. The heater 208 for heating is disposed immediately above the heater for discharge or to the discharge port. The heater 208 for heating can alleviate the viscous drag forward and around the valve to make stable discharge possible. By making the heater 208 for heating built in the ceiling plate 3, the liquid discharge head itself can be miniaturized. Further, since the heater 208 for heating, the element for driving the heater 208, and the like can be disposed at arbitrary positions independently of the heater 207 for discharge, the element for driving the heater 207, and the wiring pattern provided in the device substrate 1, they can be disposed at optimum positions for heating the liquid for discharge, and, as the degree of freedom is high from the viewpoint of the space, the members can be disposed compactly to miniaturize the liquid discharge head itself.

Figure 10A:
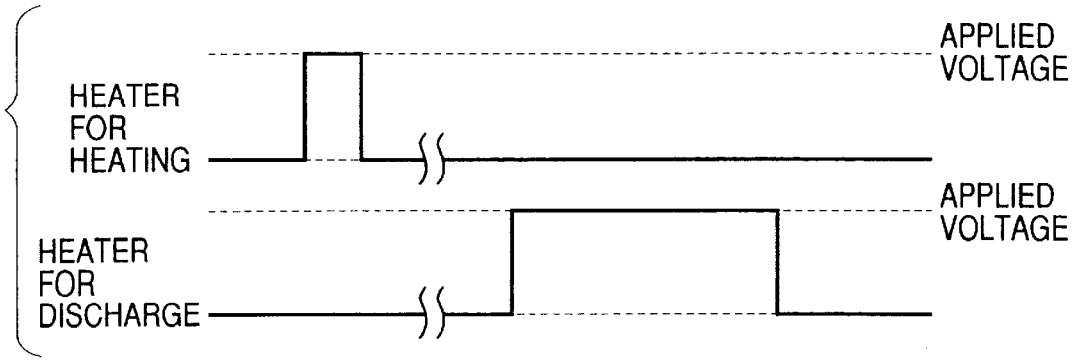
FIGS. 10A and 10B illustrate an example of waveforms of driving pulses of a heater for discharge and a heater for heating of the liquid discharge head shown in FIG. 6, and another example, respectively.
Figure 10B:
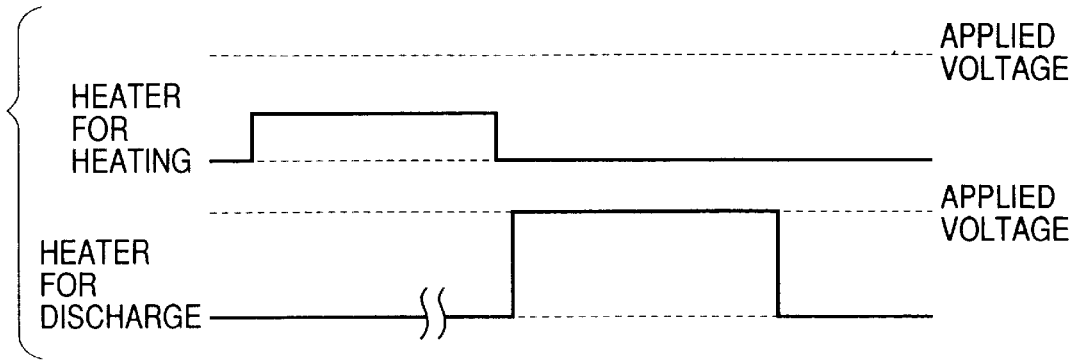

Advantages of the structure where the heater 208 for heating is disposed on the ceiling plate 3 are now described in further detail. In the present structure, the heater 207 for discharge is formed using a semiconductor process with regard to the element substrate 1. In the ceiling plate 3 which forms the liquid flow path 7 by its connection to the element substrate 1, the heater 208 for heating which controls the discharge amount, the element for driving the heater 208 for heating (driver), and a drive control circuit are disposed with regard to each liquid flow path 7. This makes the degree of freedom high with regard to the resistance, the shape, the driving voltage, the driving pulse width, and the like of the heater 208 for heating. For example, the heater 208 for heating can be driven by short pulses at the same voltage as that of the heater 207 for discharge as shown in FIG. 10A, and, the heater 208 for heating can be driven by long pulses at voltage lower than that of the heater 207 for discharge as shown in FIG. 10B. This is because, since the heater 208 for heating is disposed on the ceiling plate 3, it is free from the restriction set by the conditions for bubbling of the heater 207 for discharge. Further, in the context of the recent trend toward higher density of the recording elements (360 dpi or more), it is difficult from the viewpoint of the layout to mount the heaters 208 for heating, the elements for driving the heater 208 (drivers), and the control logic circuit on the element substrate 1 having the heaters 207 for discharge provided thereon while securing the above-mentioned degree of freedom of the driving pulse width and the like. However, in the present embodiment, since the heater 208 for heating and the driver for the heater for heating are structured to be mounted on the ceiling plate 3, such a thing can be materialized with the degree of freedom being secured.

With regard to the discharge amount of the liquid, since the amount varies according to the proportions between the fluid resistance in front of the bubbling center and the fluid resistance at the back of the bubbling center, when the fluid resistance at the back is constant, the smaller the fluid resistance in front is, the more the discharge amount of the liquid becomes. Therefore, in the present embodiment, before the bubbling, only the liquid in front is heated before bubbling by the heater 208 for heating provided on the downstream side of the heater for discharge. More specifically, driving pulses which cause heating action to heat only the liquid in front are supplied to the heater 208 for heating. In this way, the discharge amount can be controlled by controlling energy to be applied to the heater 208 for heating to control the viscosity of the liquid and to substantially change the fluid resistance in front.

Conventionally, a structure exists where a heater for heating is disposed in front of a heater for discharge on the same substrate. However, in this case, it is difficult to dispose the heater for heating on the front side due to the severe restriction on the layout. However, in the present embodiment, since, correspondingly to the respective heaters 208 for heating, independent driving elements (drivers) and the like can be provided which supply driving voltage lower than that of the heaters for discharge, optimally sized heaters 208 for heating can be disposed at optimum positions. Besides, the overall size of a chip does not become larger. It is to be noted that, the voltage applied to the heater for heating can be made lower than that applied to the heater for discharge not only by using a voltage converter but also by connecting another power supply to the ceiling plate. If the power supply for the logic circuit is used as this power supply, no additional power supply is necessary.

Further, if the signal generating portion of the driver for the heater for discharge is the signal generating portion of the driver for the heater for adjustment, the heater for discharge and the heater for adjustment can be driven synchronously with each other.

If the ceiling plate further has sensors for sensing the state in the respective liquid flow paths corresponding to the heaters for adjustment, the state in the liquid flow paths can be adjusted by the heaters for adjustment independently of the heaters for discharge.

Next, the structure of assigning the circuits and the elements to the element substrate 1 and the ceiling plate 3 is described.

Figure 8A:
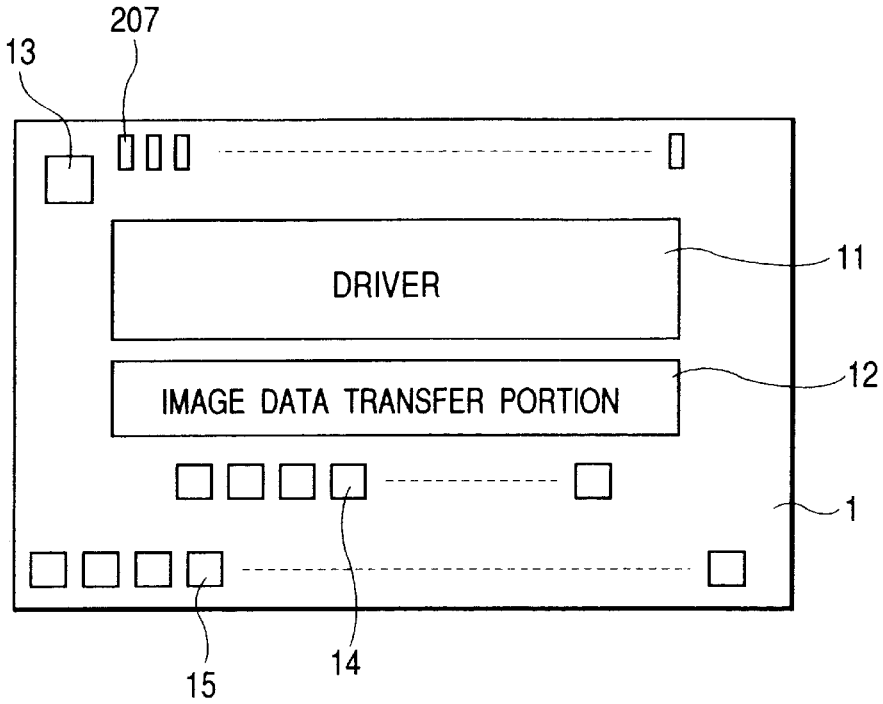
FIGS. 8A and 8B are plan views of the element substrate and the ceiling plate, respectively, illustrating the circuit structure of the liquid discharge head shown in FIG. 6.
Figure 8B:
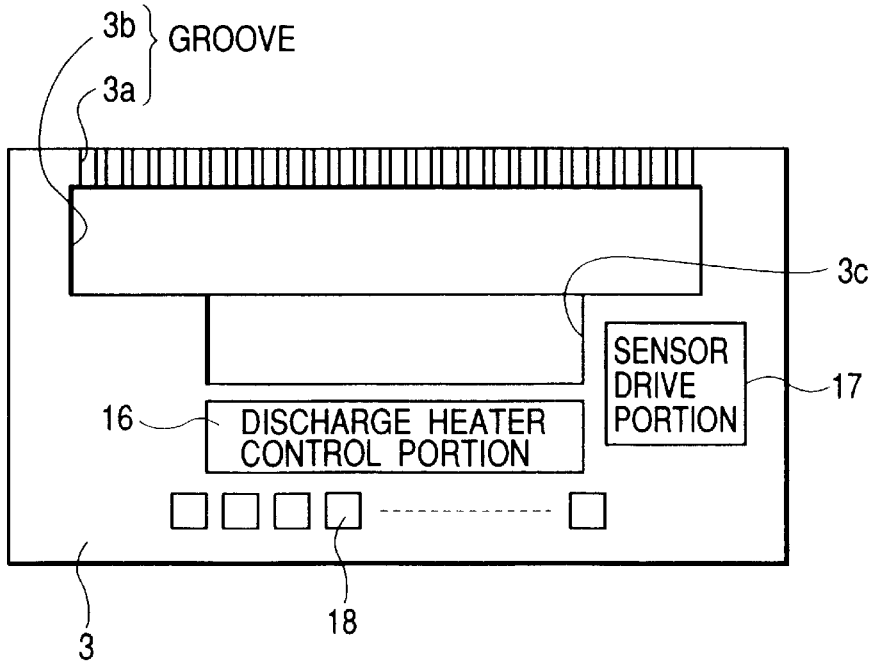

FIGS. 8A and 8B illustrate the circuit structure of the liquid discharge head shown in FIG. 6. FIG. 8A is a plan view of the element substrate while FIG. 8B is a plan view of the ceiling plate. It is to be noted that the surfaces shown in FIGS. 8A and 8B face each other.

As shown in FIG. 8A, the element substrate 1 is provided with the plurality of parallelly arranged heaters 207 for discharge, drivers 11 for driving the heaters 207 for discharge according to image data, an image data transfer portion 12 for outputting input image data to the drivers 11, and a sensor 13 for measuring parameters necessary for controlling the conditions for driving the heaters 207 for discharge.

The image data transfer portion 12 is formed of a shift register for outputting serially inputted image data parallelly to the respective drivers 11, and a latch circuit for temporally storing data outputted from the shift register. It is to be noted that the image data transfer portion 12 may output image data individually correspondingly to the respective heaters 207 for discharge, or may output image data correspondingly to a plurality of blocks formed by dividing the arranged heaters 207 for discharge. Specifically, by providing a plurality of shift registers with regard to one head and by inputting data transferred from the storage device to the plurality of shift registers, it is also possible to accommodate higher printing speed with ease.

As the sensor 13, a temperature sensor for measuring the temperature in the vicinity of the heaters 207 for discharge, a resistance sensor for monitoring the resistance values of the heaters 207 for discharge, or the like is used.

With regard to the discharge amount of a jetted liquid drop, the discharge amount is mainly related to the bubbled volume of the liquid. The bubbled volume of the liquid varies depending on the temperature of the heater 207 for discharge and of its vicinity. Accordingly, by measuring the temperature of the heater 207 for discharge and of its vicinity using a temperature sensor, by, according to the result and prior to the application of a heat pulse for discharging the liquid, applying a pulse (preheat pulse) which is too small to discharge the liquid, and by changing the pulse width and the output timing of the preheat pulse, the temperature of the heater 207 for discharge and of its vicinity is adjusted to discharge a predetermined amount of a liquid drop. In this way, the quality of an image can be maintained.

Further, with regard to the energy necessary for bubbling the liquid at the heater 207 for discharge, if the conditions for heat radiation is the same, the energy is represented as the necessary energy to be inputted per unit area of the heater 207 for discharge multiplied by the area of the heater 207 for discharge. Based on this, the voltage across the heater 207 for discharge, current through the heater 207 for discharge, and the pulse width are set such that the necessary energy can be obtained. Here, the voltage applied to the heater 207 for discharge can be held substantially constant by supplying voltage from the power source of the liquid discharge device body. With regard to the current through the heater 207 for discharge, the resistance value of the heater 207 for discharge varies depending on the variation in the film thickness of the heater 207 for discharge caused in the manufacturing process of the element substrate 1, depending on the lot, and depending on the element device 1. Accordingly, if the pulse width to be applied is constant and the resistance value of the heater 207 for discharge is larger than the setting, the passing current value becomes smaller, the energy to be inputted to the heater 207 for discharge becomes insufficient, and the liquid can not be bubbled appropriately. On the other hand, if the resistance value of the heater 207 for discharge becomes smaller, even when the same voltage is applied, the current value becomes larger than the setting. In this case, too much energy is generated by the heater 207 for discharge, which may result in damage or shorter lifetime of the heater 207 for discharge. Thus, there is also a method where the resistance value of the heater 207 for discharge is always monitored by a resistance sensor and the power source voltage and the heat pulse width are varied according to the monitored resistance value such that substantially constant energy is applied to the heater 207 for discharge.

On the other hand, as shown in FIG. 8B, in addition to grooves 3*a* and 3*b* forming the liquid flow paths and the common liquid chamber, the ceiling plate 3 is provided with a sensor drive portion 17 and a discharge heater control portion 16 for controlling the conditions for driving the heaters 207 for discharge based on the result of the output from the sensor driven by the sensor drive portion 17. It is to be noted that a supply port 3*c* communicating with the common liquid chamber is opened in the ceiling plate 3 for supplying the liquid from the external to the common liquid chamber.

Further, contact pads 14 and 18 for connection for the purpose of electrically connecting the circuits and the like formed on the element substrate 1 with the circuits and the like formed on the ceiling plate 3 at opposing portions on the surface of the element substrate 1 and on the surface of the ceiling plate 3, respectively, which are connected with each other. The element substrate 1 is further provided with external contact pads 15 to be input terminals of electric signals from the external. The element substrate 1 is larger than the ceiling plate 3, and the external contact pads 15 are provided at positions which are exposed and not covered with the ceiling plate 3 when the element substrate 1 and the ceiling plate 3 are connected to each other.

Here, an example of a procedure of forming the circuits and the like on the element substrate 1 and on the ceiling plate 3 is described.

With regard to the element substrate 1, first, the circuits forming the drivers 11, the image data transfer portion 12, and the sensor 13 are formed on the silicon substrate using semiconductor wafer process technology. Then, the heaters 2 for discharge are formed as described in the above. Finally, the contact pads 14 for connection and the external contact pads 15 are formed.

With regard to the ceiling plate 3, first, the circuits forming the discharge heater control portion 16 and the sensor drive portion 17 are formed on the silicon substrate using semiconductor wafer process technology. Then, the grooves 3*a* and 3*b* forming the liquid flow paths and the common liquid chamber and the supply port 3*c* are formed by film forming technology and etching as described in the above. Finally, the contact pads 18 for connection are formed.

When the element substrate 1 and the ceiling plate 3 formed as described in the above are aligned with and connected to each other, the heaters 207 for discharge are disposed correspondingly to the respective liquid flow paths, and the circuits and the like formed on the element substrate 1 and on the ceiling plate 3 are electrically connected through the pads 14 and 18 for connection, respectively. The electric connection may be, for example, carried out by mounting gold bumps on the pads 14 and 18 for connection, but other methods may also be used. In this way, by electrically connecting the element substrate 1 and the ceiling plate 3 to each other through the contact pads 14 and 18 for connection, the electric connection between the above-described circuits can be carried out together with the connection of the element substrate 1 and the ceiling plate 3. After the element substrate 1 and the ceiling plate 3 are connected to each other, an orifice plate 4 is connected to the front end of the liquid flow paths 7, which completes the liquid discharge head. It is to be noted that, though, in the above description, the structure for the electric connection of the heaters 207 for discharge provided on the element substrate 1 is described in detail, the structure for the electric connection of the heaters 208 for heating provided on the ceiling plate 3 is substantially similar to the structure described in the above, and thus, the description thereof is omitted herein.

Figure 9:
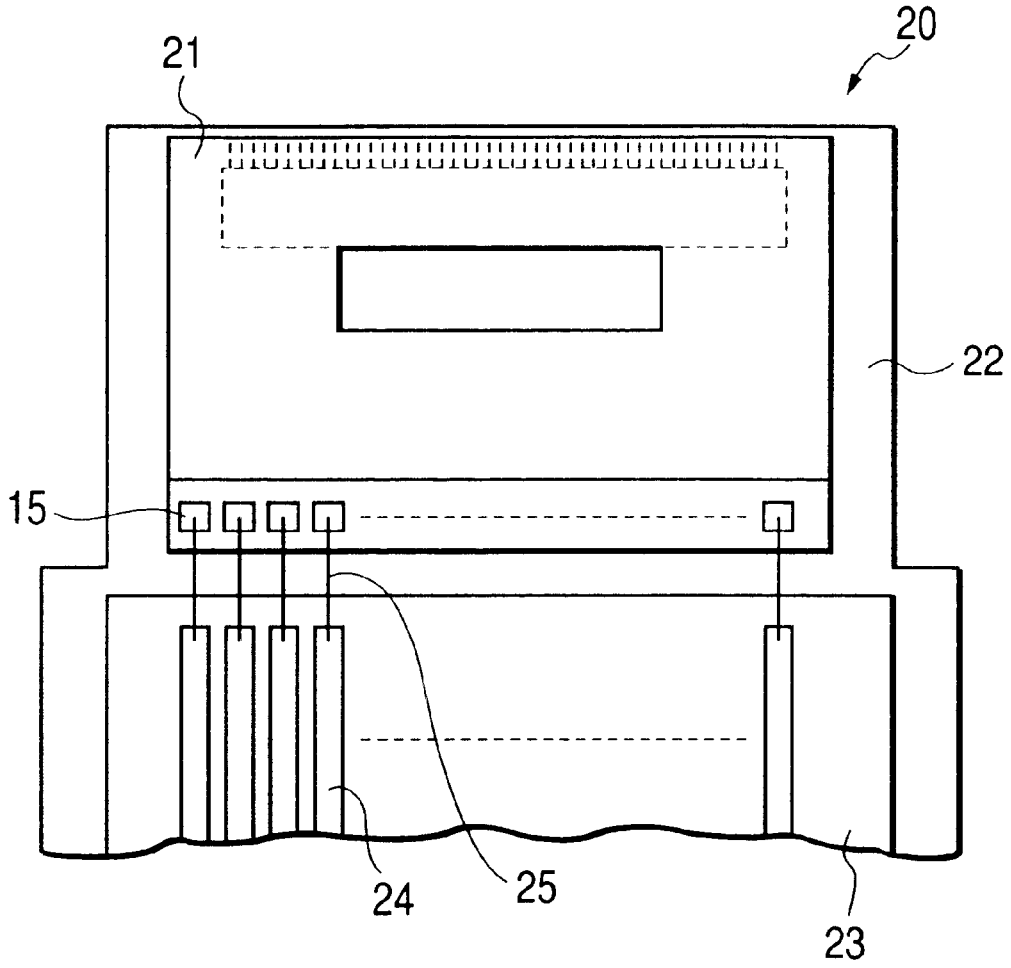
FIG. 9 is a plan view of a liquid discharge head unit having the liquid discharge head shown in FIG. 6 mounted thereon.

When the liquid discharge head obtained in this way is mounted on a head cartridge or a liquid discharge device, as shown in FIG. 9, the liquid discharge head is fixed on a base substrate 22 having a printed wiring board 23 mounted thereon to form a liquid discharge head unit 20. In FIG. 9, the printed wiring board 23 is provided with a plurality of wiring patterns 24 to be electrically connected to the head control portion of the liquid discharge device. These wiring patterns 24 are electrically connected with the external contact pads 15 through bonding wires 25. Since the external contact pads 15 are provided only on the device substrate 1, the electric connection between the liquid discharge head 21 and the external can be carried out in the same way as in the case of a conventional liquid discharge head. Though an example where the external contact pads 15 are provided on the element substrate 1 is described herein, the external contact pads 15 may be provided not on the element substrate 1 but only on the ceiling plate 3.

As described in the above, by assigning the various circuits and the like for driving and controlling the heaters 207 for discharge to the element substrate 1 and the ceiling plate 3 taking into consideration the electric connection of the two, concentration of these circuits and the like either on the element substrate 1 or on the ceiling plate 3 is avoided, which allows miniaturization of the liquid discharge head. Further, by carrying out the electric connection between the circuits and the like provided on the element substrate 1 and the circuits and the like provided on the ceiling plate 3 through the contact pads 14 and 18 for connection, the number of the electrically connecting portions to the external of the head is decreased, and thus, improvement in the reliability, reduction of the number of parts, and further miniaturization of the head can be materialized.

Further, by assigning the above-described circuits and the like to the element substrate 1 and the ceiling plate 3, the yield of the element substrate 1 can be improved, and, as a result, the manufacturing cost of the liquid discharge head can be lowered. Further, since the element substrate 1 and the ceiling plate 3 are formed of a material based on the same material of silicon, the thermal expansion coefficient of the element substrate 1 is the same as that of the ceiling plate 3. As a result, even when the heaters 207 for discharge are driven and the element substrate 1 and the ceiling plate 3 are thermally expanded, the two are not misaligned, and the positional accuracy between the heaters 207 for discharge and the liquid flow paths 7 is sufficiently maintained.

In the present embodiment, the above-described circuits and the like are assigned according to their functions. The standards of such assignment are described in the following.

The circuits which correspond to the heaters 207 for discharge individually or with a block being as the unit through electric wiring connections are formed on the element substrate 1. In the example shown in FIGS. 8A and 8B, the drivers 11 and the image data transfer portion 12 fall within them. Since driving signals are parallelly given to the respective heaters 207 for discharge, wirings have to be drawn around for the signals. Accordingly, if such circuits are formed on the ceiling plate 3, the number of connections between the element substrate 1 and the ceiling plate 3 becomes large and insufficient connections are more liable to occur. By forming the circuits on the element substrate 1, the insufficient connections between the heaters 207 for discharge and the circuits can be prevented.

Analogue portions such as control circuits are easily influenced by heat, and thus, are provided on a substrate where the heaters 207 for discharge are not provided, that is, on the ceiling plate 3. In the example shown in FIGS. 8A and 8B, the discharge heater control portion 16 falls within them.

The sensor 13 may be provided on the element substrate 1 or on the ceiling plate 3 depending on the situation. For example, when the sensor 13 is a resistance sensor, since a resistance sensor is meaningless or can not measure with sufficient accuracy if it is not provided on the element substrate 1, it is provided on the element substrate 1. When the sensor 13 is a temperature sensor, if the sensor is to detect temperature rise due to a malfunctioning heater driving circuit or the like, it is preferable that the sensor is provided on the element substrate 1. On the other hand, if the state of ink is to be judged by temperature rise through the ink as described in the following, it is preferable that the sensor is provided on the ceiling plate 3, or both on the element substrate 1 and on the ceiling plate 3.

Others such as circuits which correspond to the heaters 207 for discharge neither individually nor with a block being as the unit, circuits which are not necessarily required to be provided on the element substrate 1, and sensors which, even if provided on the ceiling plate 3, do not influence the measurement accuracy, are formed either on the element substrate 1 or on the ceiling plate 3 depending on the situation so as not to concentrate on one of the element substrate 1 or the ceiling plate 3. In the example shown in FIGS. 8A and 8B, the sensor drive portion 17 falls within them.

By providing the respective circuits, sensors, and the like either on the element substrate 1 or on the ceiling plate 3 according to the above standards, the respective circuits, sensors, and the like can be assigned with a good balance while the number of electric connections between the element substrate 1 and the ceiling plate 3 is made as small as possible.

In this way, while it is preferable to dispose on the element substrate 1 driving elements and the like which correspond individually and are directly connected to the large number of heaters 207 for discharge provided on the element substrate 1, circuits for controlling the timing of driving the driving elements and the like are not necessarily required to be disposed on the element substrate 1 and may be appropriately disposed in an open space either on the element substrate 1 or on the ceiling plate 3. This also applies to the heaters 208 for heating. More specifically, driving elements and the like which correspond individually and are directly connected to the large number of heaters 208 for heating provided on the ceiling plate 3 are disposed on the ceiling plate 3, while circuits for controlling the timing of driving the driving elements and the like are appropriately disposed in an open space either on the element substrate 1 or on the ceiling plate 3.

Embodiment 3

Figure 11:
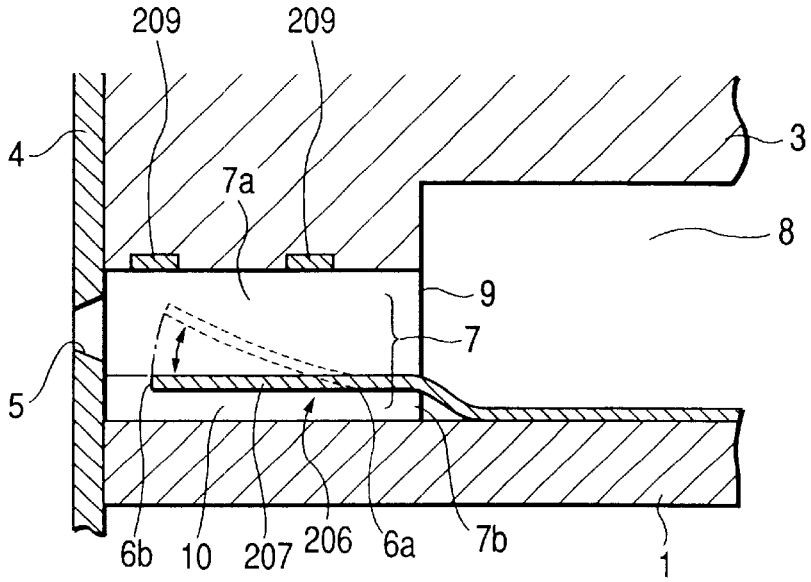
FIG. 11 is a sectional view along the direction of a liquid flow path illustrating the structure of a liquid discharge head as a third embodiment of the present invention.

FIG. 11 shows a third embodiment of the present invention. Structures similar to those in the first and second embodiments are denoted by identical reference numbers and the description thereof is omitted. In the present embodiment, two heaters 209 for heating are disposed in one liquid flow path 7: one on the upstream side and the other on the downstream side of the heater 207 for discharge. This structure has effects that the refill characteristics after the liquid is discharged is improved and the menisci are stabilized.

Embodiment 4

Figure 12:
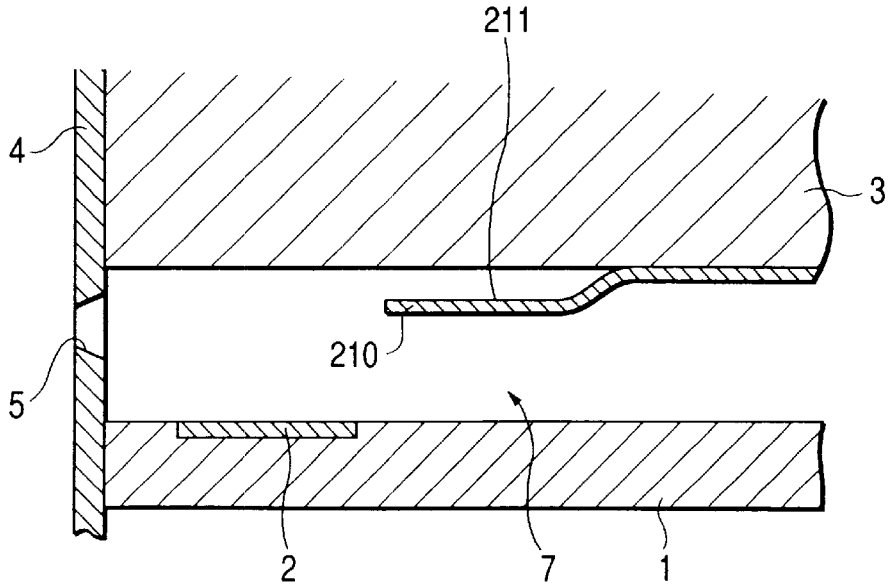
FIG. 12 is a sectional view along the direction of a liquid flow path illustrating the structure of a liquid discharge head as a fourth embodiment of the present invention.

FIG. 12 shows a fourth embodiment of the present invention. Structures similar to those in the first to third embodiments are denoted by identical reference numbers and the description thereof is omitted. In the present embodiment, similar to the case of the first embodiment, the heater 207 for discharge is provided on the element substrate 1. Further, a heater 211 for heating is formed on a movable member 210 provided on the ceiling plate 3. The structure of the ceiling plate 3 itself is similar to that in the first embodiment, and the structure of the movable member 211 is substantially identical with that of the movable member 206 of the first embodiment. The method of manufacturing them is substantially similar except that the element substrate 1 and the ceiling plate 3 are reversed. In the present embodiment, the heater 211 for heating can lower the viscosity of the liquid to maintain the discharge performance. In particular, since the heater 211 for heating is formed on the movable member 210 which is positioned in the liquid flow path 7, the heating can be carried out efficiently. Further, since the heater 2 for discharge and its driving element are assigned to the element substrate 1 while the heater 211 for heating and its driving element are assigned to the movable member 210, the space can be saved and their desired driving can be carried out independently of each other.

Embodiment 5

Figure 13:
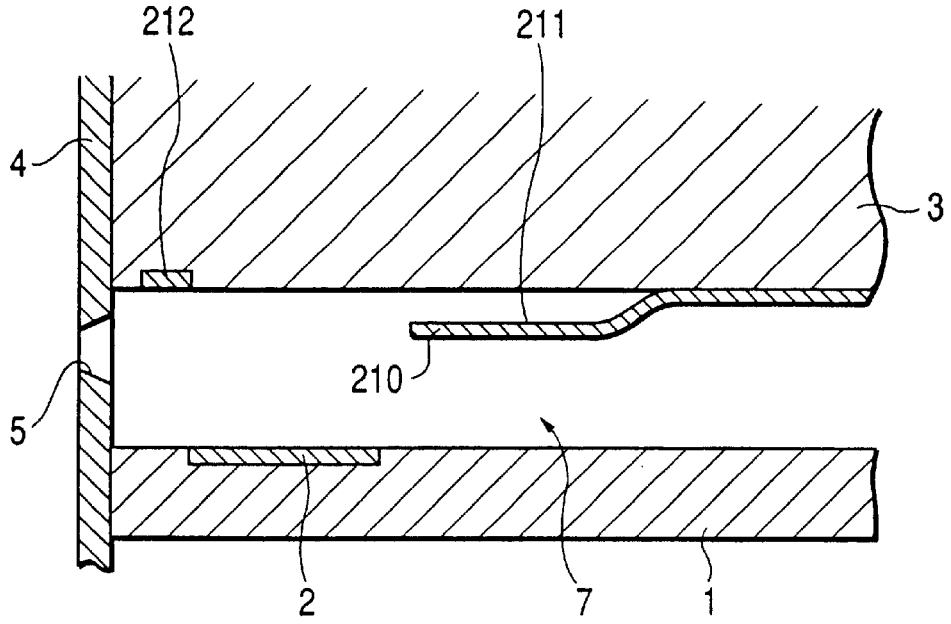
FIG. 13 is a sectional view along the direction of a liquid flow path illustrating the structure of a liquid discharge head as a fifth embodiment of the present invention.
Figure 14:
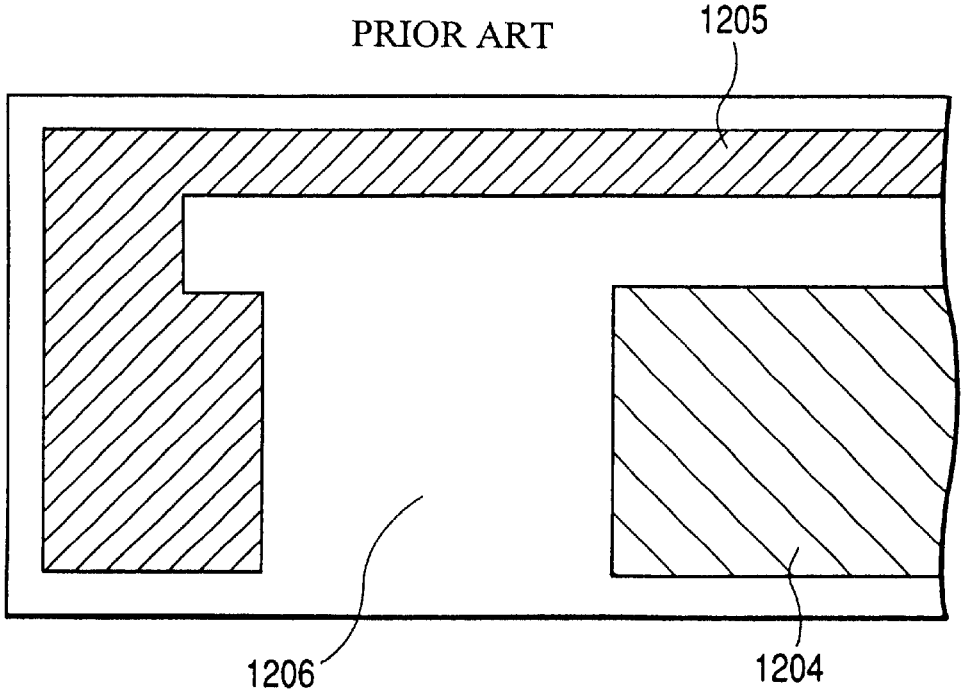
FIG. 14 PRIOR ART
FIG. 14 is a schematic view illustrating a conventional structure where a heater for discharge is provided on a movable member.

FIG. 13 shows a fifth embodiment of the present invention. Structures similar to those in the first to fourth embodiments are denoted by identical reference numbers and the description thereof is omitted. In the present embodiment, similar to the case of the fourth embodiment, the heater 207 for discharge is provided on the element substrate 1 and the heater 211 for heating is formed on the movable member 210. Further, another heater 212 for heating is formed on the ceiling plate 3. The structure of the ceiling plate 3 is similar to the case of the first embodiment. The present embodiment has, in addition to the effects of the fourth embodiment, effects that the refill characteristics after the liquid is discharged is improved and the menisci are stabilized.

What is claimed is:

1. A liquid discharge head comprising a substrate, a ceiling plate bonded to the substrate, a liquid flow path formed between the substrate and the ceiling plate, and a cantilever-like movable member having a fixed end fixed to the substrate and a free end extending into the liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes bubbling of a liquid in the liquid flow path between the movable member and the substrate to discharge the liquid.

2. A liquid discharge head as claimed in claim 1, wherein the upper electrode layer and the lower electrode layer are formed of a high-melting metal.

3. A liquid discharge head as claimed in claim 1, wherein the insulating layer is made of SiN.

4. A liquid discharge head as claimed in claim 1, wherein the heat generating resistive layer is electrically connected to the electrode layers upstream and downstream in the discharge direction of the heat generating portion.

5. A liquid discharge head as claimed in claim 1, wherein the upper electrode layer and the lower electrode layer are formed so as to range from the front surface side to the rear surface side of the movable member.

6. A liquid discharge head as claimed in claim 1, further comprising a heater for adjustment provided separately from the heat generating portion in the liquid flow path correspondingly to the heater for discharge, and a driver for driving the heater for adjustment.

7. A liquid discharge head as claimed in claim 6, wherein a voltage applied to the heater for adjustment is lower than a voltage applied to the heat generating portion.

8. A liquid discharge head as claimed in claim 7, wherein the ceiling plate is provided with a voltage converter to ensure that the voltage applied to the heater for adjustment by the voltage converter is lower than that applied to the heat generating portion.

9. A liquid discharge head as claimed in claim 7, wherein the heater for adjustment is connected to a power source different from a power source connected to the heat generating portion to ensure that the voltage applied to the heater for adjustment is lower than that applied to the heat generating portion.

10. A liquid discharge head as claimed in claim 9, wherein the power source connected to the heater for adjustment is a power source for a logic circuit.

11. A liquid discharge head as claimed in claim 6, wherein the heater for adjustment is provided on the downstream side in the discharge direction of the heat generating portion.

12. A liquid discharge head as claimed in claim 6, wherein the heater for adjustment is provided in plurality on the upstream side and the downstream side, respectively, in the discharge direction of the heat generating portion.

13. A liquid discharge head as claimed in claim 6, wherein the area of the heater for adjustment is smaller than that of the heat generating portion.

14. A liquid discharge head as claimed in claim 6, wherein the area of the driver for the heater for adjustment is smaller than that of the driver for the heat generating portion.

15. A liquid discharge head as claimed in claim 6, wherein a signal generating portion of the driver for the heat generating portion is common to a signal generating portion of the driver for the heater for adjustment.

16. A liquid discharge head as claimed in claim 6, wherein the ceiling plate further comprises in the liquid flow path a sensor for sensing the state of the inside of the liquid flow path corresponding to the heater for adjustment.

17. A method of manufacturing a liquid discharge head which comprises a substrate, a ceiling plate bonded to the substrate, a liquid flow path formed between the substrate and the ceiling plate, and a cantilever-like movable member having a fixed end fixed to the substrate and a free end extending into the liquid flow path, the method comprising the steps of:

providing a space forming member on the substrate;

forming the movable member of a lower protective layer, a heat generating resistive layer, a lower electrode layer, an insulating layer, an upper electrode layer, and an upper protective layer stacked from the side of the substrate in the mentioned order; and removing the space forming member to shape the movable member in the form of a cantilever.

18. A method of manufacturing a liquid discharge head as claimed in claim 17, wherein the upper electrode layer and the lower electrode layer are formed of a high-melting metal.

19. A method of manufacturing a liquid discharge head as claimed in claim 17, wherein the insulating layer is made of SiN.

20. A method of manufacturing a liquid discharge head as claimed in claim 17, wherein the heat generating resistive layer is electrically connected to the electrode layers upstream and downstream in the discharge direction of the heat generating portion.

21. A method of manufacturing a liquid discharge head as claimed in claim 17, wherein the upper electrode layer and the lower electrode layer are formed so as to range from the front surface side to the rear surface side of the movable member.

22. A microelectromechanical device comprising a cantilever-like movable member having a fixed end fixed to a substrate and a free end extending into a liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes heating of a liquid in the liquid flow path.

23. A microelectromechanical device as claimed in claim 22, wherein the upper electrode layer and the lower electrode layer are formed of a high-melting metal.

24. A microelectromechanical device as claimed in claim 23, wherein the insulating layer is made of SiN.

25. A microelectromechanical device as claimed in claim 22, wherein the heat generating resistive layer is electrically connected to the electrode layers upstream and downstream in the discharge direction of the heat generating portion.

26. A microelectromechanical device as claimed in claim 22, wherein the upper electrode layer and the lower electrode layer are formed so as to range from the front surface side to the rear surface side of the movable member.

27. A liquid discharge head comprising a substrate, a ceiling plate bonded to the substrate, a liquid flow path formed between the substrate and the ceiling plate, and a cantilever having a fixed end fixed to the substrate and a free end extending into the liquid flow path, wherein the cantilever is formed of a lower protective layer, a heat generating resistive layer, a lower electrode layer, an insulating layer, and upper electrode layer, and an upper protective layer stacked from the side of the substrate in the mentioned order, and wherein application of a voltage to heat generating portion of the heat generating resistive layer causes bubbling of a liquid in the liquid flow path between the cantilever and the substrate to discharge the liquid.

28. A method of manufacturing a liquid discharge head which comprises a substrate, a ceiling plate bonded to the substrate, a liquid flow path formed between the substrate and a free end extending into the liquid flow path, the method comprising the steps of:

providing a space forming member on a substrate;

forming a cantilever of a lower protective layer, a heat generating resistive layer, a lower electrode layer, an insulating layer, an upper electrode layer, and an upper protective layer stacked from the side of the substrate in the mentioned order; and removing the space forming member to shape the cantilever.

29. A microelectromechanical device comprising a cantilever having a fixed end fixed to a substrate and a free end extending into a liquid flow path, wherein the cantilever is formed of a lower protective layer, a heat generating resistive layer, a lower electrode layer, an insulating layer, an upper electrode layer, and an upper protective layer stacked from side of the substrate in the mentioned order, and wherein application of a voltage to a heat generating portion of the heat generating resistive layer causes heating of a liquid in the liquid flow path.

30. A liquid discharged head comprising a substrate, a ceiling plate bonded to the substrate, a liquid flow path formed between the substrate and the ceiling plate, and a movable member having a fixed end fixed to the substrate and a free end extending into the liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes bubbling of a liquid in the liquid flow path between the movable member and the substrate to discharge the liquid.

31. A method of manufacturing a liquid discharge head which comprises a substrate, a ceiling plate bonded to the substrate, a liquid flow path formed between the substrate and the ceiling plate, and a movable member having a fixed end fixed to the substrate and a free end extending into the liquid flow path, the method comprising the steps of:

providing a space forming member on a substrate;

forming a movable member of a lower protective layer, a heat generating resistive layer, a lower electrode layer, and insulating layer, an upper electrode layer, and an upper protective layer stacked from the side of the substrate in the mentioned order; and removing the space forming member to shape the movable member.

32. A microelectromechanical device comprising a movable member having a fixed end fixed to a substrate and a free end extending into a liquid flow path, wherein the movable member is formed of a lower protective layer, a heat generating resistive layer, a lower electrode layer, an insulating layer, an upper electrode layer, and an upper protective layer stacked from the side of the substrate in the mentioned order, and wherein application of a voltage to a heat generating portion of the heat generating resistive layer causes heating of a liquid in the liquid flow path.

* * * * *

UNITED STATES PATENT AND TRADEMARK OFFICE

CERTIFICATE OF CORRECTION

PATENT NO. : 6,402,302 B1
DATED : June 11, 2002
INVENTOR(S) : Teruo Ozaki et al.

It is certified that error appears in the above-identified patent and that said Letters Patent is hereby corrected as shown below:

Column 5,
Line 39, “o f” should read -- of --;
Line 45, “”helm” should read -- help --; and
Line 66, “$\mu$m” should read -- $\mu$m. --.

Column 6,
Line 46, “external” should read -- outside --.

Column 7,
Line 46, “port” should read -- ports --.

Column 10,
Line 21, “is” should read -- are --.

Column 11,
Line 5, “electric” should read -- external electric --; and
Line 6, “from the external” should be deleted.

Column 12,
Line 2, “external” should read -- outside --.

Column 13,
Line 6, “Others” should read -- Other --.

Column 16,
Line 27, “and” (first occurrence) should read -- an --;
Line 29, “to” should read -- to a --;
Line 36, “substrate” (second occurrence) should read -- substrate and the ceiling plate, and a cantilever having a fixed end fixed to the substrate --; and
Line 58, “discharged” should read -- discharge --.

UNITED STATES PATENT AND TRADEMARK OFFICE

CERTIFICATE OF CORRECTION

PATENT NO. : 6,402,302 B1
DATED : June 11, 2002
INVENTOR(S) : Teruo Ozaki et al.

It is certified that error appears in the above-identified patent and that said Letters Patent is hereby corrected as shown below:

Column 17,
Line 15, "and" (first occurrence) should read -- an --.

Signed and Sealed this

Twenty-first Day of January, 2003

JAMES E. ROGAN
*Director of the United States Patent and Trademark Office*